US008745826B2

(12) United States Patent
Vangheluwe et al.

(10) Patent No.: US 8,745,826 B2
(45) Date of Patent: Jun. 10, 2014

(54) WIRE PROFILE FOR CARD CLOTHING

(75) Inventors: Lieven Vangheluwe, Ronse (BE); Philip Furnier, Deerlijk (BE); Karel Van Eenooghe, Aalter (BE)

(73) Assignees: NV Bekaert SA, Zwevegem (BE); Bekaert Carding Solutions NV, Zwevegem (BE)

( * ) Notice: Subject to any disclaimer, the term of this patent is extended or adjusted under 35 U.S.C. 154(b) by 0 days.

(21) Appl. No.: 13/695,737

(22) PCT Filed: May 3, 2011

(86) PCT No.: PCT/EP2011/057047

§ 371 (c)(1), (2), (4) Date: Nov. 1, 2012

(87) PCT Pub. No.: WO2011/138322

PCT Pub. Date: Nov. 10, 2011

(65) Prior Publication Data

US 2013/0042437 A1 Feb. 21, 2013

(30) Foreign Application Priority Data

May 4, 2010 (EP) ..... 10161813

(51) Int. Cl.
*D01G 15/84* (2006.01)

(52) U.S. Cl.
USPC ..... 19/114

(58) Field of Classification Search
USPC ..... 19/114; D15/66, 78
See application file for complete search history.

(56) References Cited

U.S. PATENT DOCUMENTS

| | | | | |
|---|---|---|---|---|
| 4,233,711 | A | 11/1980 | Hollingsworth | |
| 4,964,195 | A | 10/1990 | Hollingsworth | |
| 5,581,848 | A * | 12/1996 | Egerer | 19/114 |
| 5,755,012 | A | 5/1998 | Hollingsworth | |
| 6,195,843 | B1 | 3/2001 | Graf | |
| D445,433 | S * | 7/2001 | Hollingsworth | D15/78 |
| 6,408,487 | B1 | 6/2002 | Atkinson | |
| 6,920,671 | B2 | 7/2005 | Graf | |
| 6,996,878 | B2 * | 2/2006 | Maidel et al. | 19/114 |
| 7,735,201 | B1 | 6/2010 | Reeves | |
| 7,818,848 | B2 * | 10/2010 | Maerz | 19/114 |
| 2009/0158558 | A1 * | 6/2009 | Marz | 19/114 |
| 2012/0255143 | A1 * | 10/2012 | Iten et al. | 19/106 R |

FOREIGN PATENT DOCUMENTS

| | | | |
|---|---|---|---|
| DE | 40 38 352 | A1 | 6/1992 |
| EP | 1 408 142 | A1 | 4/2004 |
| GB | 854 090 | A | 11/1960 |
| GB | 2 257 164 | A | 1/1993 |
| GB | 2439638 | B | 1/2008 |
| WO | WO 00/26450 | A1 | 5/2000 |

* cited by examiner

*Primary Examiner* — Shaun R Hurley
(74) *Attorney, Agent, or Firm* — Foley & Lardner LLP

(57) ABSTRACT

A wire profile comprises a rib portion and a plurality of teeth over the length of the rib portion. The teeth are sloped with a back slope representing the backbone of the teeth and a front slope representing the side in direct contact with fiber. The back slope has a tangent forming a hack angle with the rib portion, and the front slope is divided into at least two segments, a tip segment converging with the back slope to form a tip of the teeth and serving to penetrate between fibers, and an undercut segment to retain the fibers. The undercut segment has a tangent forming an undercut angle with the rib portion, and the undercut angle is at each point in the undercut segment greater than the maximum of the hack angle and smaller than the smallest value of the tip angle.

14 Claims, 3 Drawing Sheets

WIRE PROFILE FOR CARD CLOTHING

TECHNICAL FIELD

The present invention concerns a wire profile for card clothing comprising a rib portion and plurality of teeth over the length of said rib portion.

BACKGROUND ART

Carding is one of the fundamental operations in manufacturing of yarn and in the production of carded nonwoven products. Carding is a process that transforms the raw material, such as cotton, wool or polyester fibres, into a coherent web by disentangling and straightening the fibres and eliminating undesired materials. At the output side of the card, the web is combined into a so-called "sliver", a one dimensional ribbon of fibres; or transferred as a web to the next process. The control of fibres during the carding process is carried out through metallic and/or flexible card clothing and by control of the air flows. Although the basic principles underlying the carding process have not changed for over 100 years, there has been a constant improvement in the manufacturing technology thus resulting in an improved speed and efficiency.

U.S. Pat. Nos. 4,233,711, 4,964,195, 464,389, 5,755,012 and 6,408,487 relate to different metallic card clothing. WO00/26450 describes card clothing comprising a strip of profile wire having a plurality of longitudinally aligned teeth with respective overhanging tips. The edge-face of each tooth under the overhanging tip includes at least one undercut edge-segment spaced along the edge-face from the tip. This undercut edge-segment increases the retention of fibres by the edge-face during carding by means of a preferably substantially horizontal step in the undercut. WO00/26450 describes that for performance and lifetime related reasons, the undercut edge segments can be optimized by careful design, this statement, however, leaves the drawback unsolved that the wires cannot be made via state of the art rotary punching technology.

The prior art fails to address a desirable card clothing that has the following characteristics (i) a perfect control of the fibre, this is an extremely critical step during carding because the card clothing must not only be capable of penetrating into the fibre material, but also retain the fibre without resulting in damage to the fibres; (ii) desirable card clothing should be able to transfer the fibre between rollers clothed with wires, e.g. from the main cylinder to the removal cylinder known as doffer. An issue noted with the wire profile known in the art is that strong fibre taking capacity leads to fibre loading at the stop-start of the cards. It should be noted that the type of fibre also plays a major part in transfer for instance the card profile being used for woven or non-woven units. (iii) desirable card clothing should minimize the various macroscopic deformations to the fibres such as transverse compression, stretching and twisting; (iv) Certain wire profiles known in the art such as in WO 00/26450 cannot be produced by rotary punching technique and it is thus desirable that the card clothing be mass producible using rotary punching technique for specific geometries and; (v) must be wear resistant so that replacements of card clothing on the rollers and plates of the carding machines are less common thus saving time and maintenance costs. The wire profile known in the art have problems with decreased tooth strength due to stress concentration at the edges thus occurrence of breakage of part of tooth is common and the fibre retention capacity is lost.

In order to obtain desirable card clothing, major amount of research has been focussed on the geometry of the card clothing, these hook shaped card clothing act directly on the fibres to break down and tease the tufts into individual fibres; and to orient the fibres.

To manufacture card clothing, wire forms the basic starting material which is subjected to one or more drawing and rolling operations followed by punching a series of consecutive slots to form the teeth using a suitable mechanical stamping device as described in GB 2 257 164 A.

GB 2 257 164 A elaborates on two punching techniques, vertical and rotary, both these techniques are known for producing teeth in a blade. The vertical punching technique involves a vertically reciprocating cutter tool passing in and out of a shaped die over which the blade is temporarily held. Thus, in accordance with this known technique, the blade must be moved intermittently and periodically held stationary in order to perform the punching operation. One of the disadvantages with this technique is that it is a very slow process to manufacture saw toothed wire and it drastically impacts the efficiency of manufacturing rollers or replacing rollers, cylinders, doffers with saw toothed wires because the low volume output. The rotary punching technique on the other hand involves the use of a rotating cutting tool which is set to pass through a shaped die, over which the blade passes continuously. The advantage of this technique is the high speed and ability to manufacture saw toothed wires in kilometers of stretch in short span of time. U.S. Pat. No. 6,195,843 describes one rotating cutting tool which has a rotary milling spindle with a blanking tool attached to it, the angular position of the milling spindle can be continuously registered by means of an angular decoder, and the feed mechanism can be controlled on the basis of the angular position that has been determined in this manner. There is however a disadvantage with the rotary punching technique which is the limitation to manufacture any geometry and shapes of saw toothed wire. Furthermore GB 2 439 638 mentions the disadvantages of manufacturing card clothing using mechanical tool means (referring to vertical and rotary punching) and in particular mentions the problems of oxide residues during thermal treatment, production accuracy deteriorates with wear and tear on the tool and suggests to use laser for producing card clothing. Precision may be better since the laser beam doesn't wear during the process. A disadvantage of laser cutting is the high energy required. With part geometries, lasers also face the problem with a part absorbing more heat, and consequently the probability of thermal runaways or violent reactions like blowouts increases.

SUMMARY OF INVENTION

It is an object of the present invention to provide for a wire profile for card clothing which overcomes the drawbacks of known carding wires by a specific well-defined geometry of the teeth of wire profile for card clothing which can be easily and consistently produced using the rotary punching technique.

It is another object of the present invention to provide for a wire profile which efficiently penetrates, captures and controls the synthetic and natural fibres during the carding process.

It is another object of the present invention to provide for a wire profile to create fibre space so that increased volume of fibres can be retained in the card wire. Using the present invention on a doffer of a card, fibre recycling on the cylinder is reduced.

It is another object of the present invention to provide for a wire profile which imparts frictional resistance to the fibre during the carding process.

Thus, one aspect of the invention is a wire profile for card clothing comprising a rib portion and plurality of teeth over the length of said rib portion, wherein said teeth are sloped with a back slope representing the backbone of said teeth and a front slope representing the side in direct contact with fibre, said back slope having a tangent forming a back angle with the rib portion, said front slope being divided into at least two segments, a tip segment and a undercut segment, wherein said tip segment converges with the said back slope to form a tip of said teeth and said tip segment serves to penetrate between fibres, said tip segment having a tangent forming a tip angle with the rib portion, said undercut segment is capable of retaining the fibre, said undercut having a tangent forming an undercut angle with the rib portion, said undercut angle being at each point in the undercut segment greater than the maximum of the back angle and being smaller than the smallest value of the tip angle. In another aspect of the present invention, the wire profile further comprises a base segment originating below the said undercut segment and said base segment converges towards the said rib portion, and wherein said base segment having a tangent forming a base angle with the rib portion and maximum of said base angle is greater than the said undercut angle.

The wire profile of the present invention allows the possibility to be manufactured by rotary punching technique.

Thus, another aspect of the invention is a method of manufacturing wire profile of the present invention by a process comprising the steps of: (i) feeding wire by means of continuous feeding mechanism; and (ii) performing a slicing procedure using a rotary blade, wherein said rotary blade is set to pass through a shaped die.

BRIEF DESCRIPTION OF FIGURES IN THE DRAWINGS

DETAILED DESCRIPTION OF THE INVENTION

Figure 1:
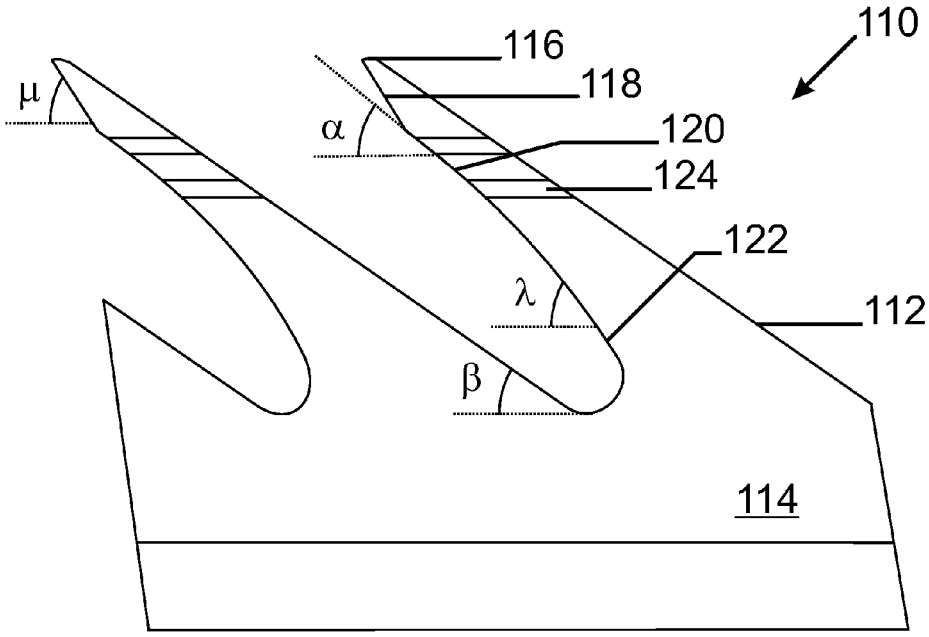
FIGS. 1, 2 and 3 shows different embodiments of wire profile in lateral view according to the invention.

FIG. 1 depicts a wire profile 110 for card clothing comprising a rib portion and plurality of teeth over the length of said rib portion 114, wherein said teeth are sloped with back slope 112 representing the backbone of said teeth and front slope 118, 120, 122 representing the side in direct contact with fibre, said back slope having a tangent forming a back angle β with the rib, said front slope being divided into at least two segments, a tip segment converging with the said back slope to form a tip 116 of said teeth and said tip segment 118 serving to penetrate between fibres, said tip segment having a tangent forming a tip angle μ with the rib portion, and a undercut segment 120 to retain the fibres, said undercut having a tangent forming an undercut angle with the rib portion, said undercut angle α being at each point in the undercut segment greater than the maximum of the back angle and being smaller than the smallest value of the tip angle μ. The front slope comprises a further base segment 122 originating below the said undercut segment 120 and converges towards the said rib portion, and wherein said base segment having a tangent forming a base angle λ with the rib portion and maximum of said base angle λ is greater than the said undercut angle α.

Figure 2:
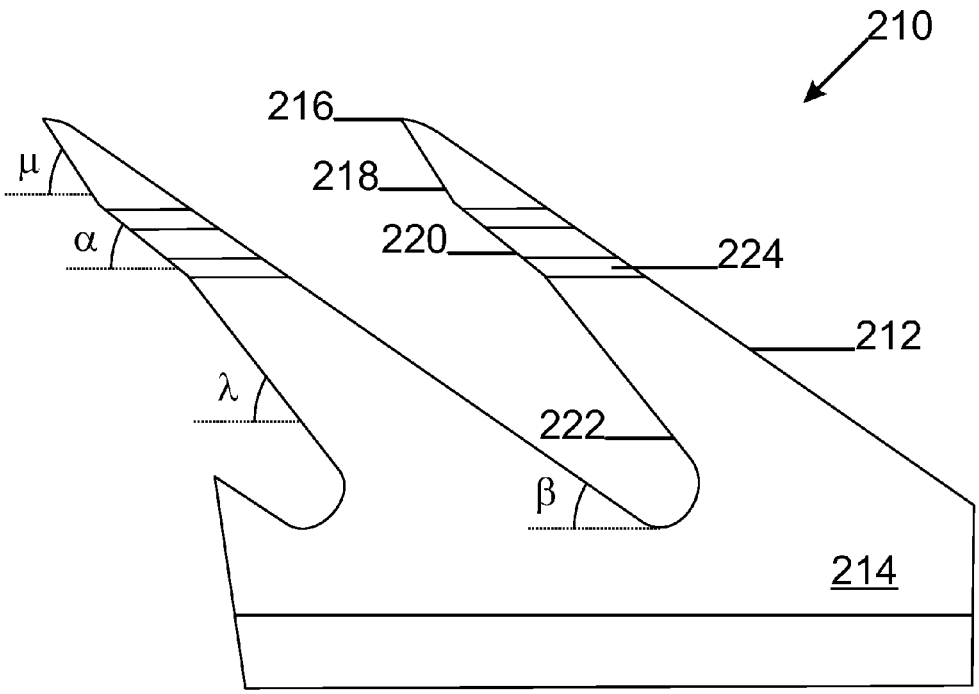

FIG. 2 depicts a wire profile 210 for card clothing comprising a rib portion and plurality of teeth over the length of said rib portion 214, wherein said teeth are sloped with back slope 212 representing the backbone of said teeth and front slope 218, 220, 222 representing the side in direct contact with fibre, said back slope having a tangent forming a back angle β with the rib, said front slope being divided into at least two segments, a tip segment converging with the said back slope to form a tip 216 of said teeth and said tip segment 218 serving to penetrate between fibres, said tip segment having a tangent forming a tip angle μ with the rib portion, and a undercut segment 220 to retain the fibres, said undercut having a tangent forming an undercut angle with the rib portion, said undercut angle α being at each point in the undercut segment greater than the maximum of the back angle and being smaller than the smallest value of the tip angle μ. The front slope comprises a further base segment 222 originating below the said undercut segment 220 and converges towards the said rib portion, and wherein said base segment having a tangent forming a base angle λ with the rib portion and maximum of said base angle λ is greater than the said undercut angle α.

Figure 3:
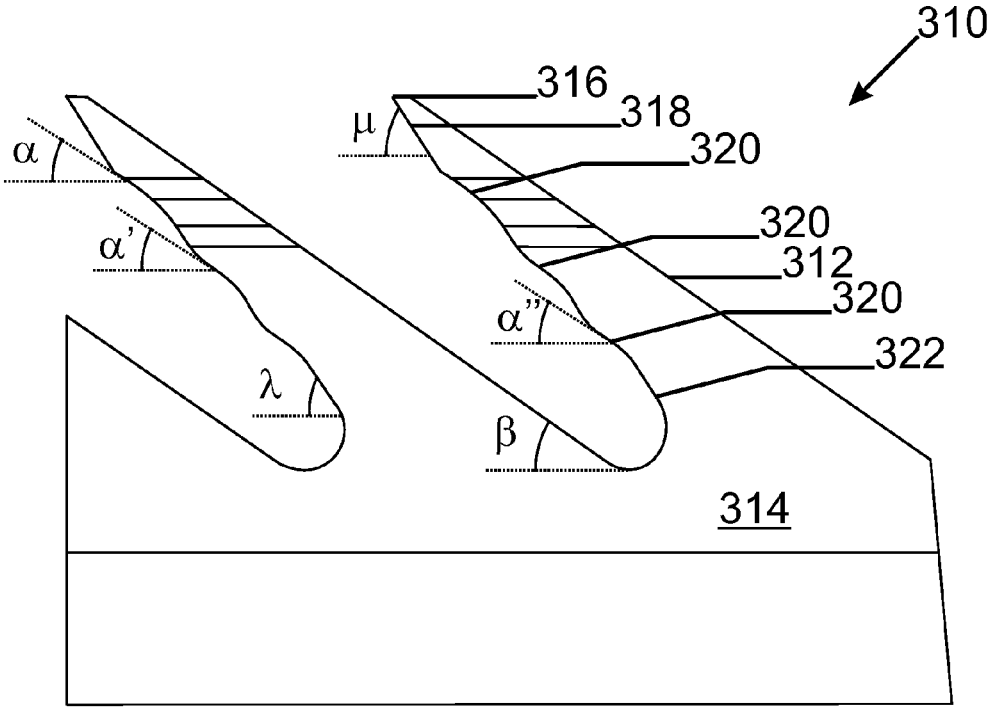

FIG. 3 depict a wire profile 310 for card clothing comprising a rib portion and plurality of teeth over the length of said rib portion 314, wherein said teeth are sloped with back slope 312 representing the backbone of said teeth and front slope 318, 320, 322 representing the side in direct contact with fibre, said back slope having a tangent forming a back angle β with the rib, said front slope being divided into at least two segments, a tip segment converging with the said back slope to form a tip 316 of said teeth and said tip segment 318 serving to penetrate between fibres, said tip segment having a tangent forming a tip angle μ with the rib portion, and a undercut segment 320 to retain the fibres, said undercut having a tangent forming an undercut angle with the rib portion, said undercut angle α being at each point in the undercut segment greater than the maximum of the back angle and being smaller than the smallest value of the tip angle μ. The front slope comprises a further base segment 322 originating below the said undercut segment 320 and converges towards the said rib portion, and wherein said base segment having a tangent forming a base angle λ with the rib portion and maximum of said base angle λ is greater than the said undercut angle α. In one preferred embodiment of the present invention, the front slope further comprises at least one additional undercut segment. In one preferred embodiment of the present invention, the front slope comprises 2, 3 or 4 undercut segments and said undercut segments have a tangent forming an undercut angle (for instance α', α", α'") with the rib portion. The front slope in FIG. 3 has 3 undercut segments having 3 undercut angles (α, α', α"). In one preferred embodiment of the present invention, the three undercut angles (α', α", α'") are equal.

Difference between α and β ranges from 0.1-20°, preferably 0.5-10°, more preferably 0.5°-5°. In one preferred embodiment of the present invention, the angle α is 39°, the angle β equals 35°, the angle λ is 57° and the angle μ is 52°.

In one preferred embodiment of the present invention, the wire profile for card clothing comprises a rib portion and plurality of teeth over the length of said rib portion, wherein said teeth are sloped with back slope representing the backbone of said teeth and front slope representing the side in direct contact with fibre, said back slope having a tangent forming a back angle with the rib portion, said front slope being divided into three segments, a tip segment, a undercut segment and a base segment, wherein said tip segment converges with the said back slope to form a tip of said teeth and said tip segment serves to penetrate between fibres, said tip segment having a tangent forming a tip angle with the rib portion, said undercut segment is capable of retaining the fibres, said undercut having a tangent forming an undercut angle with the rib portion, said undercut angle being at each point in the undercut segment greater than the maximum of the back angle and being smaller than the smallest value of the tip angle and, wherein said front slope comprises a further base segment originating below the said undercut segment and said base segment converges towards the said rib portion, and wherein said base segment having a tangent forming a base angle with the rib portion and maximum of said base angle is greater than the said undercut angle, in order to allow rotary punching.

In one preferred embodiment of the present invention, the said base angle $\lambda$ is smaller than the smallest value of the tip angle $\mu$.

In one preferred embodiment of the present invention, the said tip angle ranges between 40° and 135°, preferably between 45° and 90°, more preferably between 45° and 70°, most preferably between 50° and 65°.

In one preferred embodiment of the present invention, the said back angle ranges between 10° and 80° preferably between 20° and 50°, more preferably between 30° and 45°.

Figure 4:
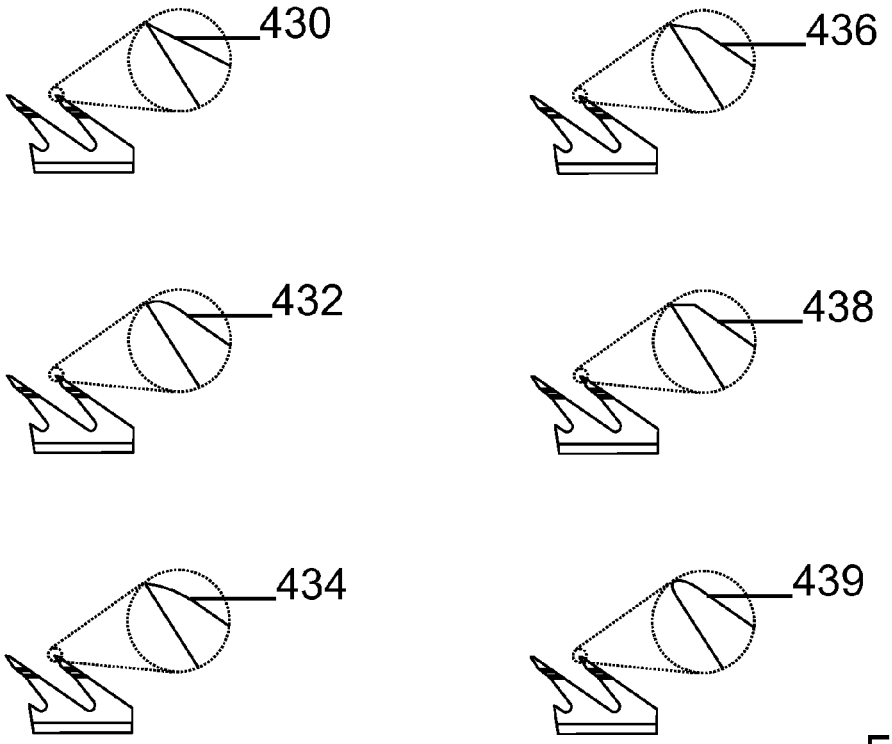
FIG. 4 shows embodiments of tip shapes according to the invention.

FIG. 4 depicts different shapes of the tip for the teeth of the present invention. In one embodiment of the present invention the shape of the tip is cut point 430. In another embodiment of the present invention the shape of the tip is semi aquiline 432. In yet another embodiment of the present invention the shape of the tip is full aquiline 434. In yet another embodiment of the present invention the shape of the tip is double back angle 436. In yet another embodiment of the present invention the shape of the tip is flat land 438. In yet another embodiment of the present invention the shape of the tip is rounded 439.

The term "striations" 124, 224 refers to a number of tiny parallel grooves/veins along the longitudinal direction of the wire profile. Such a profile is preferably manufactured in the undercut segment of the teeth wherein the fibres are retained. In one embodiment of the present invention the teeth of the wire profile comprises striations along the longitudinal direction of the said wire profile. In another embodiment of the present invention the striations are positioned along the said undercut segment. In yet another embodiment of the present invention the striations are in form of grooves and veins occurring in alternative forms along the either side of the wire profile to increase fibre retention capabilities.

Figure 5:
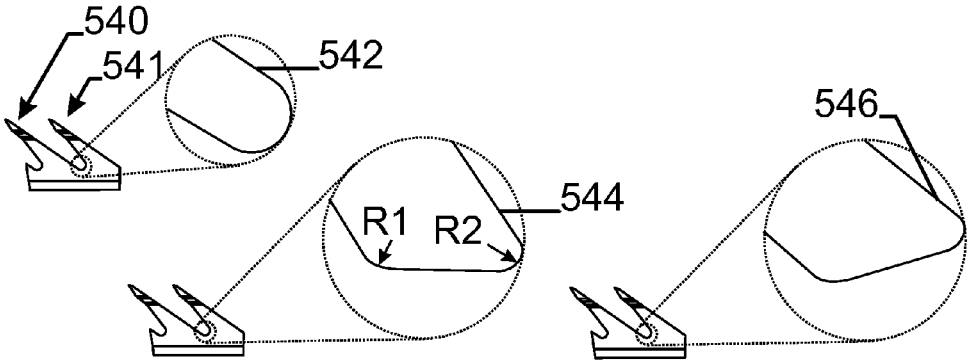
FIG. 5 shows embodiments of spaced segments between a pair of teeth according to the invention.

The term "spaced segment" refers to the spacing between a pair of teeth and in particular the segment refers to the base portion of said teeth wherein the front slope of one teeth and back slope of adjacent teeth converges towards the rib portion. FIG. 5 depicts different spaced segments of the present invention. In one embodiment of the present invention, the distance between the points of confluence of back slope to the rib portion of first teeth 540 to the point of confluence of front slope to the rib portion of second teeth 541 which is immediately adjacent to the first teeth is defined as the "spaced segment". In one embodiment of the present invention the spaced segment is radial curved 542. In yet another embodiment of the present invention the spaced segment is radial curved at the points of confluence R1, R2 and portion between the said points of confluence is flat bottom 544. In yet another embodiment of the present invention the spaced segment is radial curved at the points of confluence and portion between the said points of confluence is inclined at an acute angle 546.

Figure 6:
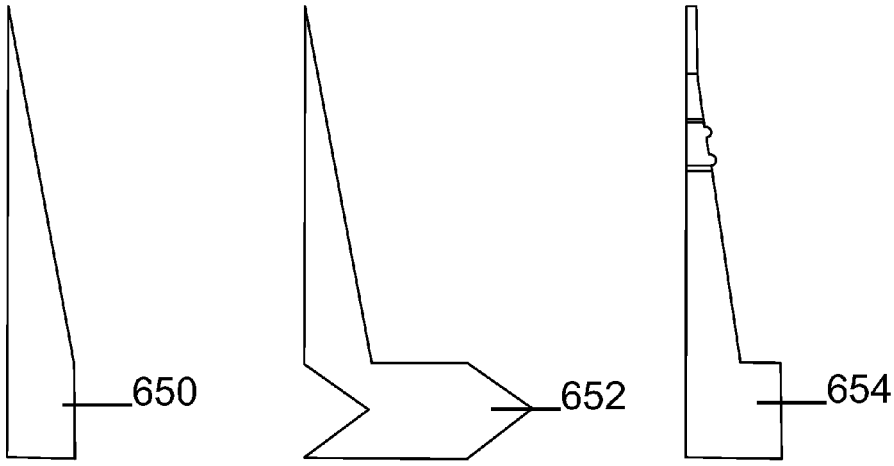
FIG. 6 shows an embodiment of wire profile in axial sectional view according to the invention.

FIG. 6 depicts different shapes of the rib portion of the wire profile of the present invention. In one embodiment of the present invention the shape of the rib is rectangular to form a wedge shaped card wire 650. In another embodiment of the present invention the shape of the rib is v-interlocking 652. In yet another embodiment of the present invention the shape of the rib is rectangular to form an L-shaped wire 654.

The term "carding machine" refers to machine consisting out of rotating cylinders clothed with card wire and (if present) quasi-stationary or stationary flat plates. For instance the term "carding machine" refers to workers, doffers, strippers, condensers, transfer rollers may be even on lickerin or cylinders (nonwoven/long staple carding); and for short staple for the doffer wire and possibly also for metallic tops. The carding machine comprises the wire profile of the present invention. In one embodiment of the present invention the carding machine is a doffer for short staple.

In another embodiment of the present invention the carding machine is a worker on a roller card for nonwovens or long staple carding.

In another embodiment of the present invention the carding machine is a doffer on a roller card for nonwovens or long staple carding.

In another embodiment of the present invention the carding machine is a transfer roller on a roller card for nonwovens or long staple carding.

In another embodiment of the present invention the carding machine is a stripper on a roller card for nonwovens or long staple carding.

A wire profile of the present invention can be made as follows. Starting product is a wire rod (usual diameters 1.20 mm or 7.0 mm) with a steel composition along the following lines: carbon content ranging from 0.30% to 2.0%, e.g. from 0.5 to 1.2%; e.g. from 0.6 to 1.1%; silicon content ranging from 0.10% to 2.5%, e.g. from 0.15 to 1.60%; manganese content ranging from 0.10% to 2.0%, e.g. from 0.50 to 0.90%; chromium content ranging from 0.0% to 2.0%, e.g. from 0.10% to 1.50%; e.g. from 0.10% to 0.90%; vanadium content ranging from 0.0% to 2.0%, e.g. from 0.05% to 0.60%, e.g. from 0.10% to 0.50%; tungsten content ranging from 0.0% to 1.5%, e.g. from 0.1% to 0.70%.

In one embodiment of the present invention, the composition of wire profile may contain either chromium or vanadium. In some other compositions both chromium and vanadium are present. The amounts of sulfur and phosphorous are preferably kept as low as possible, e.g. both below 0.05%, e.g. below 0.025%.

The wire rod is cold and dry drawn until the desired non-round profile is reached. Rolling can be carried out by means of Turks heads or by means of rolls. Drawing can be done by means of profile drawing dies. The profile depends upon the application can be square, rectangular, or take an L-form. The basis leg of the L forms the rib portion and the top leg of the L will house the eventual teeth. After this profiling, the teeth are formed in the profile wire by means of a cutting operation preferably a punching operation. The forming of the teeth may be followed by a deburring operation.

Thereafter the formed saw toothed wire profile is subjected to some heat treatments, which aim at stress-relieving the rib portion of the saw-toothed wire and at hardening the teeth. Therefore, the entire saw toothed wire is heated until a temperature in the neighborhood of 600° C. and the teeth get an additional heating until they reach a temperature of about 900° C. Thereafter the entire wire is quenched so that the foot is stress relieved and the teeth are hardened since the teeth are subjected to a much greater jump in temperature. The global heating until 600° C. can be done by means of induction heating or by means of a gas burner. The heating of the teeth until 900° C. can be done by means of an additional gas burner, or by passing the teeth through a plasma arc or torch. The quenching operation can be done in an oil bath or in a bath of polymers.

The performance of the card wire can be verified via the visual observation of the web regularity and of the number of neps present in the web. In the case that slivers or slubbing is formed at the exit of the card (that will be further processed in short staple or long staple yarn spinning), the sliver or slubbing can be tested on the number of neps and the distribution of the fibre length. In the case of cotton slivers, the AFIS (Uster's Advanced Fibre Information System) test device is a well known device used for testing sliver parameters such as number of neps, trash particles and fibre length and fibre length distribution. In the case of spun yarns, the yarn can be tested on a regularity tester and the number of neps, number of thin places and the number of thick places can be determined to assess quality of the yarn.

Using card wires according to the present invention on doffer rollers or on worker rollers more fibres will be present on these rollers than when using conventional wires. When taking a piece of card wire according to the present invention, putting fibres on the teeth and keeping the wire piece with the teeth down, more fibres are held on the teeth, less fibres drop compared to the same experiments with conventional wires.

Any reference signs do not limit the scope of the claims.

The invention claimed is:

1. A wire profile for card clothing, comprising a rib portion and a plurality of teeth over a length of said rib portion, wherein said teeth are sloped with a hack slope representing a backbone of said teeth and a front slope representing the side in direct contact with fibre, said hack slope having a tangent forming a back angle with the rib portion, said front slope being divided into at least two segments comprising a tip segment and an undercut segment, wherein said tip segment converges with the back slope to form a tip of said teeth and said tip segment is configured to penetrate between fibres, said tip segment having a tangent forming a tip angle with the rib portion, wherein said tip angle ranges between 40° and 135°, wherein said undercut segment is configured to retain the fibres, said undercut segment having a tangent forming an undercut angle with the rib portion, wherein the undercut angle is at each point in the undercut segment greater than a maximum of the hack angle and smaller than a smallest value of the tip angle in order to allow rotary punching.

2. The wire profile of claim 1, wherein said front slope further comprises a base segment originating below the undercut segment, and said base segment converges towards the rib portion, and wherein said base segment has a tangent forming a maximum base angle with the rib portion and said base angle is greater than the undercut angle.

3. A wire profile for card clothing, comprising a rib portion and a plurality of teeth over a length of said rib portion, wherein said teeth are sloped with a back slope representing a backbone of said teeth and a front slope representing the side in direct contact with fibre, said back slope having a tangent forming a back angle with the rib portion, said front slope being divided into at least to segments comprising a tip segment and an undercut segment, wherein said tip segment converges with the back slope to form a tip of said teeth and said tip segment is configured to penetrate between fibres, said tip segment having a tangent forming a tip angle with the rib portion, wherein said undercut segment is configured to retain the fibres, said undercut segment having a tangent forming an undercut angle with the rib portion, wherein the undercut angle is at each point in the undercut segment greater than a maximum of the back angle and smaller than a smallest value of the tip angle in order to allow rotary punching, wherein said front slope comprises at least one additional undercut segment.

4. The wire profile of claim 2, wherein said base angle is smaller than the smallest value of the tip angle.

5. A wire profile for card clothing, comprising a rib portion and a plurality of teeth over a length of said rib portion, wherein said teeth are sloped with a back slope representing a backbone of said teeth and a front slope representing the side in direct contact with fibre, said back slope having a tangent forming a back angle with the rib portion, said front slope being divided into at least two segments comprising a tip segment and an undercut segment, wherein said tip segment converges with the back slope to form a tip of said teeth and said tip segment is configured to penetrate between fibres, said tip segment having a tangent forming a tip angle with the rib portion, wherein said undercut segment is configured to retain the fibres, said undercut segment having a tangent forming an undercut angle with the rib portion, wherein the under cut angle is at each point in the undercut segment greater than a maximum of the back angle and smaller than a smallest value of the tip angle in order to alloy rotary punching, wherein said back angle ranges between 10° and 80°.

6. The wire profile of claim 1, Wherein said teeth further comprise striations along a longitudinal direction of the wire profile.

7. The wire profile of claim 6, wherein said striations are positioned along the undercut segment.

8. A carding machine comprising the wire profile of claim 1.

9. The carding machine of claim 8, wherein said carding machine is a doffer for short staple.

10. The carding machine of claim 8, wherein said carding machine is a worker on a roller card for nonwovens or long staple carding.

11. The carding machine of claim 8, wherein said carding machine is a doffer on a roller card for nonwovens or long staple carding.

12. The carding machine of claim 8, wherein said carding machine is a transfer roller on a roller card for nonwovens or long staple carding.

13. The wire profile of claim 1, wherein said front slope comprises at least one additional undercut segment.

14. The wire profile of claim 1, wherein said back angle ranges between 10° and 80°.

* * * * *